US007921585B2

(12) United States Patent
Wei et al.

(10) Patent No.: US 7,921,585 B2
(45) Date of Patent: Apr. 12, 2011

(54) FIREPLACE SIMULATOR WITH GLOWING EMBER EFFECT

(75) Inventors: Wang Hong Wei, Guangzhou (CN); Ou Jian Xiong, Guangzhou (CN)

(73) Assignee: Winners Products Engineering, Ltd., Kansas City, MO (US)

( * ) Notice: Subject to any disclaimer, the term of this patent is extended or adjusted under 35 U.S.C. 154(b) by 995 days.

(21) Appl. No.: 11/804,847

(22) Filed: May 21, 2007

(65) Prior Publication Data

US 2007/0240344 A1 Oct. 18, 2007

Related U.S. Application Data

(63) Continuation-in-part of application No. 11/281,786, filed on Nov. 17, 2005, now Pat. No. 7,219,456.

(51) Int. Cl.
*G09F 19/00* (2006.01)

(52) U.S. Cl. ..... 40/428

(58) Field of Classification Search ..... 40/428, 40/432; 472/61–66, 75; 362/806, 253, 234, 362/249.02, 217.01, 219, 217.05, 296.09, 362/232, 143, 140; 392/407–440
See application file for complete search history.

(56) References Cited

U.S. PATENT DOCUMENTS

| | | | | |
|---|---|---|---|---|
| 1,855,297 | A | 4/1932 | Lawrence | |
| 1,903,537 | A | 4/1933 | Sutliffe | |
| 2,175,072 | A | 10/1939 | Wompey | |
| 3,699,697 | A | 10/1972 | Painton | |
| 5,642,580 | A | 7/1997 | Hess et al. | |
| 6,047,489 | A | 4/2000 | Hess et al. | |
| 6,050,011 | A | 4/2000 | Hess et al. | |
| 6,162,047 | A | 12/2000 | Hess | |
| 6,190,019 | B1 | 2/2001 | Hess | |
| 6,269,567 | B1 | 8/2001 | MacPherson et al. | |
| 6,350,498 | B1 | 2/2002 | Hess et al. | |
| 6,363,636 | B1 | 4/2002 | Hess et al. | |
| 6,385,881 | B1 | 5/2002 | Hess | |
| 6,564,485 | B1 | 5/2003 | Hess | |
| 6,580,228 | B1 | 6/2003 | Chen et al. | |
| 6,615,519 | B2 | 9/2003 | Hess | |
| 6,691,440 | B1 | 2/2004 | Petz et al. | |
| 6,718,665 | B2 | 4/2004 | Hess et al. | |
| 6,846,094 | B2 | 1/2005 | Luk | |
| 7,236,693 | B2 * | 6/2007 | Haugom | 392/348 |
| 7,322,136 | B2 * | 1/2008 | Chen | 40/428 |
| 2005/0252051 | A1 * | 11/2005 | Chen | 40/428 |
| 2006/0213097 | A1 | 9/2006 | Haugom | |

* cited by examiner

*Primary Examiner* — Joanne Silbermann
*Assistant Examiner* — Shin Kim
(74) *Attorney, Agent, or Firm* — John C. McMahon

(57) ABSTRACT

A simulator for providing a user with a simulated burning log display providing moving patterns of light which simulate a flickering flame image. The flame image is generated by rotating a shaft with a helically wound light array such that the lights reflect off a mirror with flame shaped reflecting areas onto a partially transparent screen to give the impression to a viewer of flickering flames appearing on a front side of the screen and behind a non-burning pile of logs. The logs have flame colored light transmissive regions which are illuminated by an array of ember LED's under the control of circuitry which generates apparently randomly varying illumination levels, to thereby create a glowing ember effect.

4 Claims, 6 Drawing Sheets

FIREPLACE SIMULATOR WITH GLOWING EMBER EFFECT

CROSS REFERENCE TO RELATED APPLICATION

This is a continuation-in-part of U.S. patent application, Ser. No. 11/281,786 filed Nov. 17, 2005 for FIREPLACE SIMULATOR, which is now U.S. Pat. No. 7,219,456.

BACKGROUND OF THE INVENTION

The present invention is directed to a burning log simulator having a simulated flickering flame effect to be utilized as an insert into a conventional fireplace or as a stand alone unit and, more particularly, to such a simulator incorporating a mechanism to create a glowing ember effect.

Fire simulating devices are popular throughout the world. They can be used to simulate the flickering and glowing effects of a fire to give a desired ambiance to a room. Alternatively, they can be used to generate heat in a room by a source other than the actual burning of wood, for example, an electrical heater. Yet further, both effects can be used simultaneously.

If a user has an existing wood burning fireplace, such a device as the invention can be used as an insert into the fireplace and thereby avoid the trouble, mess and danger associated with a wood fire. If there is no existing wood burning fireplace, the device may be constructed to wall mount to give the appearance of a fireplace or may be constructed as a stand alone structure with the appearance of a stove or the like.

The key aspect of such a fire simulating device is to provide a visual appearance of a burning wood fire with a flickering flame effect. The prior art has developed many different types of complex mechanical structures for creating the flickering effect, such as metallic strips that reflect light and that are rotated on a belt with or without a fan to further cause motion in the strips and change the angle of reflectance.

SUMMARY OF THE INVENTION

The present invention was developed to provide a simple and effective structure for creating a flickering flame image, along with a variably glowing ember effect. A wood fire simulator apparatus according to the present invention comprises a housing, a rotatable light array shaft mounted horizontally within the housing and having a light array helically wound thereon, a motor engaged with the light array shaft to rotate the shaft to create moving patterns of light, a mirror in the shape of flames that is positioned within the housing to reflect the moving patterns of light from the rotating shaft, and a screen sized and positioned to receive light reflected by the mirror on one side and transmit such light to a viewer in the form of a flickering flame image on the opposite side thereof. As light is generated by the helically wound array which is rotated, moving and continuously changing patterns of the light from shaft strike the mirror and are reflected thereby to the screen where they are seen by a viewer as a generally flame shaped and flickering image.

Simulated logs are located forward of the screen and positioned in a grating type setting. The logs may be simulated to appear as wooden logs and constructed of plastic or the like or, alternatively, may be real wood which has the appearance of logs, as by painting or charring and sealing or the like. The logs are located so that the flickering flame image is positioned behind and above them, such as to give a viewer the impression that the logs are on fire and that such fire is producing the flames that are seen above the logs, but are actually only an image on the screen.

The simulator may include a heating element which may be of a resistive electrical type wherein electrical heating elements of known configurations become heated when an electrical current is conducted through them. The heating element may use other radiant, conductive, or convective types of heaters and further may include a fan to convey air across the heating element and out into the surrounding room.

A second light source may be provided in the fireplace simulator apparatus to create an effect of glowing embers. An ember light source may be positioned to illuminate red and/or orange structure at the base of the logs to simulate glowing embers. Alternatively, the ember light source may be positioned to illuminate or radiate through ember colored transparent or translucent regions of the simulated logs. The ember light source is normally controlled to be on or activated when the flame light array shaft is rotated. The ember light source may include one or more incandescent lamps or, preferably, an array of light emitting diodes. Additionally, the simulator apparatus may include a controller, such as a digital controller, which randomly varies the illumination level of the ember light sources, either in unison, in groups, or individually to create an effect of glowing embers periodically increasing in intensity as if reacting to random currents of air.

The controller includes switches which enable a user to selectively activate the rotation of the shaft and the lights associated with the shaft. The controller also allows a user to selectively activate the heating element independent of operation of the shaft.

OBJECTS OF THE INVENTION

Therefore, the objects of the present invention are: to provide a simulator that avails a viewer with an image that simulates the flickering light emanating from a burning wood fire; to provide such a simulator that utilizes a rotating shaft having a helically wound light array thereon as a light source for the image which is reflected by a flame shaped mirror or mirrors to a screen that transmits the light therethrough to the viewer in the form of a flickering image; to provide such a simulator that includes a non-wood-burning heating element that may be used cooperatively in combination with the light image or by itself to heat a surrounding room; to provide such a simulator that includes controls to allow a user to select an operating mode and also includes lighting to simulate glowing embers of a fire; and to provide such a simulator which is easy to manufacture, relatively inexpensive to produce and especially well suited for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
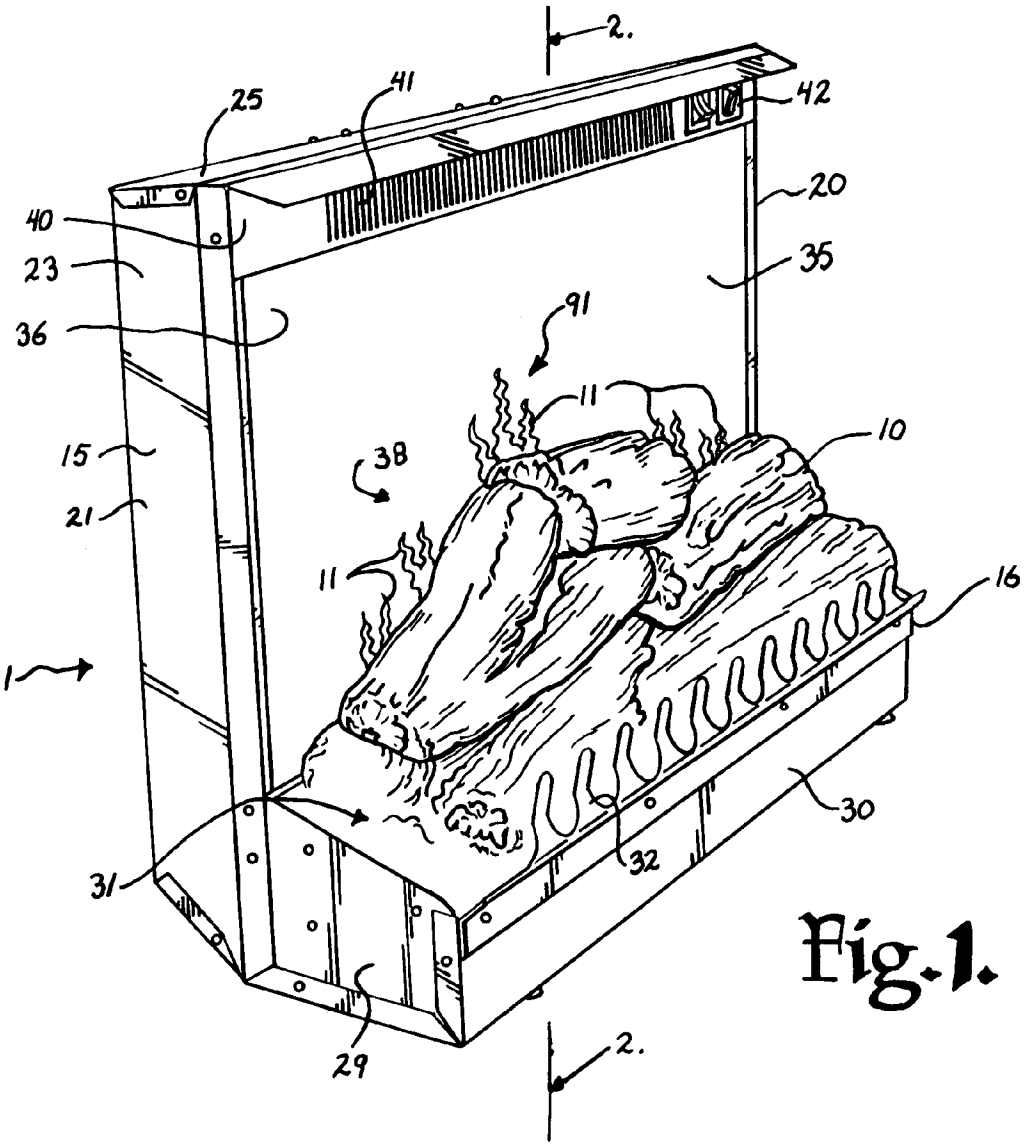
FIG. 1 is a perspective view of a wood burning simulator in accordance with the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally represents a wood burning fireplace simulator that provides a simulated pile of logs 10 behind which is located an image 11 of a flickering flame that may be viewed by a user in such a manner that the user perceives a visual effect of a burning pile of logs in a fireplace. The user may also elect to have the simulator 10 produce heat with or without the visual effect.

The simulator 1 includes a housing 15 with a forward projecting log receiving base 16 that is designed to simulate the bed of a fireplace. The simulator 1 of the illustrated embodiment is sized and shaped to fit as an insert in a conventional wood burning fireplace. However, it is foreseen that such a simulator may be constructed as a stand alone or free standing unit to simulate a wood burning stove used for heating, a wall mounted fireplace, or the like.

The housing 15 includes two rear half side walls 20 and 21 and a rear panel 22 that form a continuous partial enclosure covered by a top panel 25. The housing 15 also includes two forward projection partial lower side panels 28 and 29 joined by a front panel 30 that together form a simulated receiver or hot box 31 located beneath the pile of logs 10. A grate finger structure 32 extends upward from a front side of the hot box 31 which is otherwise open above for the purpose of receiving and illuminating the pile of logs 10, as described below.

Located on the front side of the main housing structure 23 and rearward of the pile of logs 10 is a screen 35. The screen 35 is preferably constructed of glass that has the optical properties that it is generally reflective of light striking a front side 36 thereof and is generally transmissive of light striking a rear side 37 thereof. Glass of this type is readily available and is often referred to as a one way mirror. Portions of the glass screen 35 may be blackened or otherwise treated to leave only a region 38 near or directly behind the pile of logs 10 as transmitting. This may also be accomplished by other structures such as an interior metal shroud or the like. A bottom panel 39 extends across the entire lower side of the simulator 1 and joins the structure 23 and simulated hot box 31.

Located above the screen 35 and below the top panel 25 is a comparatively narrow panel 40 with vents 41 therein and an operator control station 42 located thereon. A lower side-to-side panel 43 is located beneath the screen 35. An inwardly open slot 44 (FIG. 3) is formed along the panels 40, 20, 44 and 21 to receive and support the screen 35.

Positioned on the interior of the simulator rear structure 23 are two side cowlings 45 and 46 and an upper cowling 47 that join to form a generally open rearward region 49 with the rear panel 22 located behind the screen 35.

Figure 4:
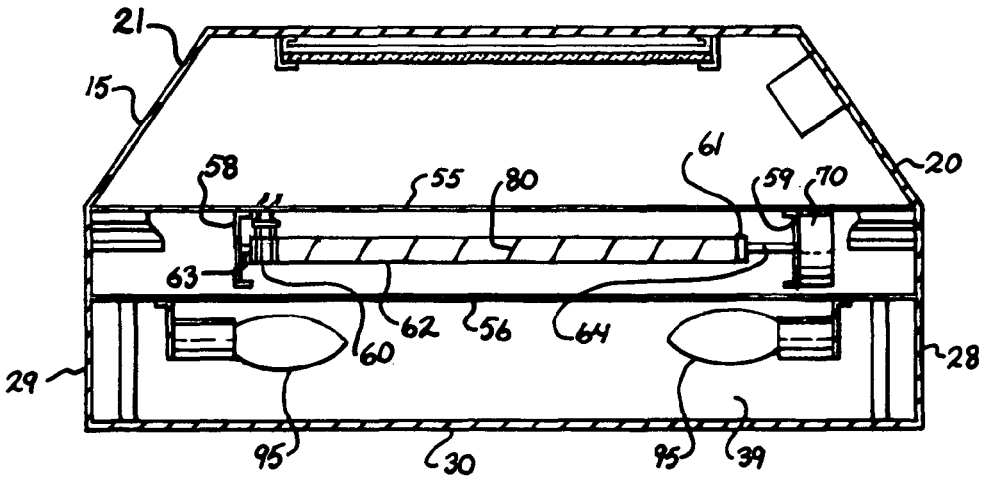
FIG. 4 is a cross sectional view of the simulator, taken along line 4-4 of FIG. 3.
Figure 6:
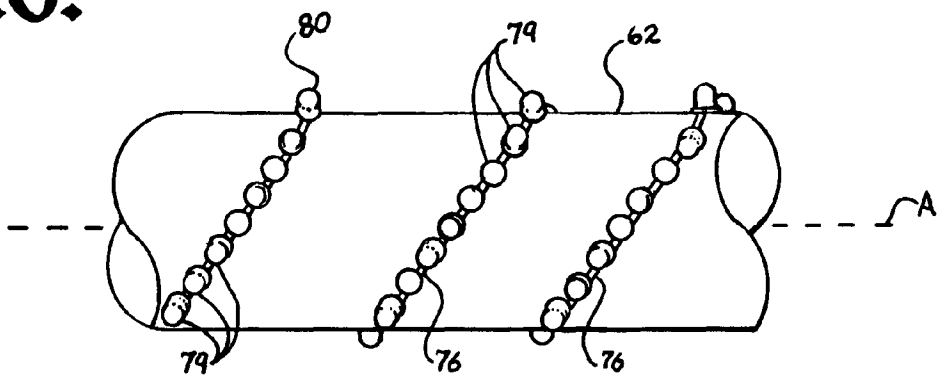
FIG. 6 is a fragmentary and yet further enlarged view of the shaft taken from the view shown in FIG. 4.
Figure 5:
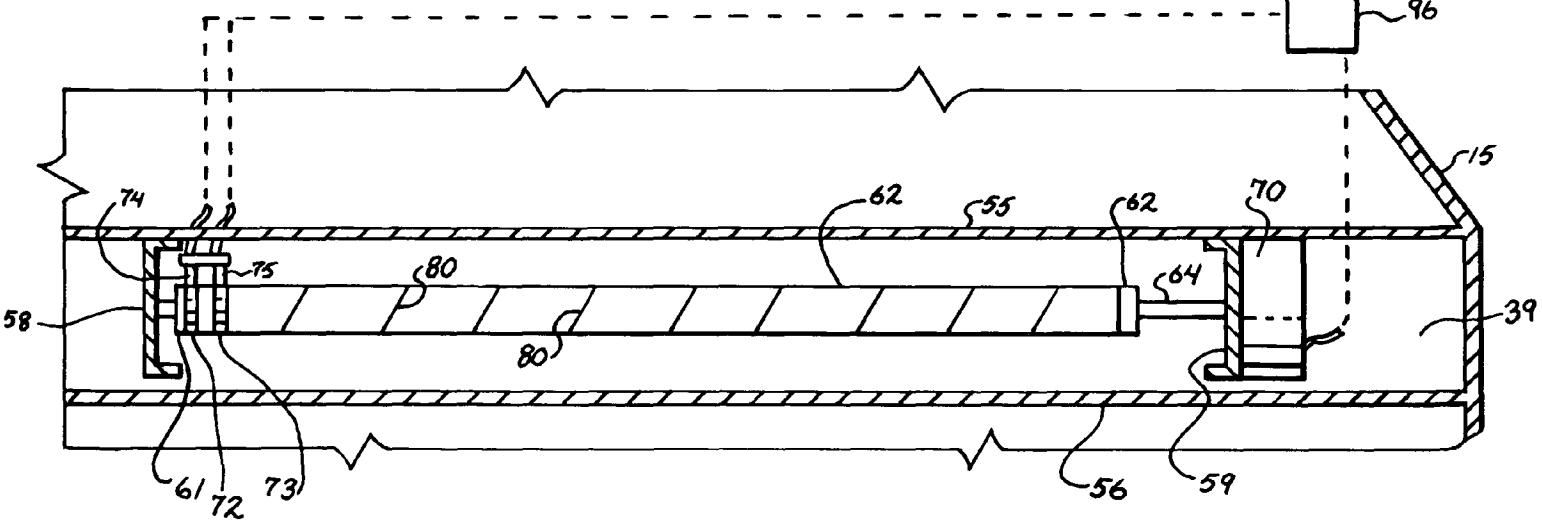
FIG. 5 is a enlarged fragmentary sectional view of the simulator showing a portion of the view seen in FIG. 4, especially showing a rotatable shaft with a helical wound light array thereon.

Positioned on the bottom panel 39 on the side of the hot box 31 are a pair of vertical side-to-side walls 55 and 56. The rearmost wall 55 is joined to two upright and facing C-shaped and spaced support channels 58 and 59 (FIGS. 4 and 5).

Pivotally mounted on each of the channels 58 and are first and second ends 60 and 61 respectively of a shaft 62. The shaft 62 is horizontally oriented and extends from across the housing 15. Axially projecting from the shaft ends 60 and 61 are axially aligned rods 63 and 64 respectively. The rod 63 is pivotally received in a bore (not seen) in channel 58, and the rod 64 is pivotally received in and extends through a bore (not seen) in channel 59.

Mounted on an outer side of the channel 59 is a motor 70 that receives and operatively rotates the shaft 62 when activated. Located opposite the motor on the shaft 62 are a pair of circumferential and axially spaced electrical contacts 72 and 73 which operably are engaged by a pair of brazed electrical followers or brushes 74 and 75. The contacts 72 and 73 are in turn electrically connected to a paired wire 76 that is helically wound about the length of the shaft 62. A plurality of LED's (light emitting diodes) or light sources 79 are mounted along the wire 76 to form an array 80.

It is foreseen that the array 80 could be provided by other structure such as a large light contained within the shaft and projecting from multiple openings or windows along the shaft.

The lights 79 are preferably arranged in a helically wound path about the shaft 62 at a helical pitch or angle of approximately 45 degrees with respect to an axis A of rotation of the shaft 62 and are generally tightly spaced relative to one another.

Figure 2:
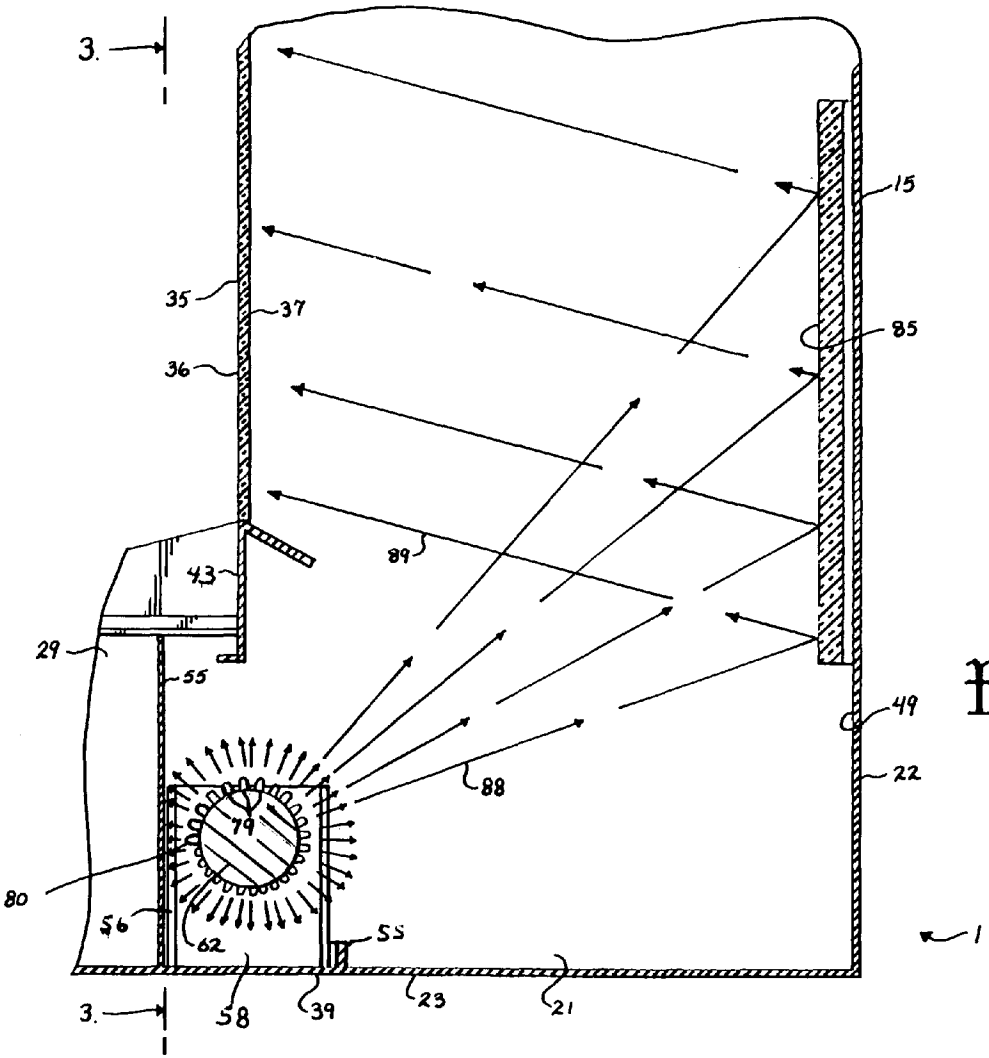
FIG. 2 is an enlarged fragmentary cross sectional view of the simulator, taken along line 2-2 of FIG. 1.
Figure 3:
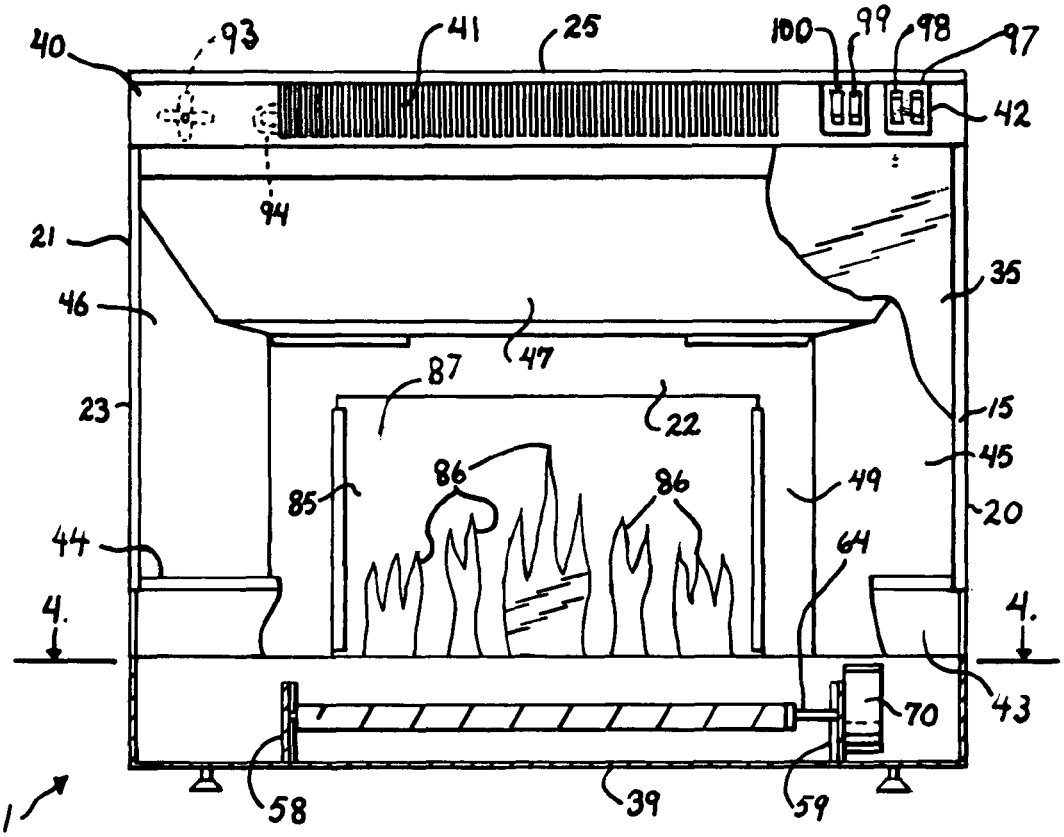
FIG. 3 is a cross sectional view of the simulator, taken along line 3-3 of FIG. 2 with a front screen mostly broken away and other portions broken away to show interior detail thereof.

Positioned on the inside of the rear panel 22 is a mirror 85 (FIG. 2). The shape of the mirror 85 is best seen in FIG. 3 and includes a plurality of fire or flame shaped segments 86. The segments 86 are spaced horizontally from side to side across the rear panel 22. The segments 86 are highest in the middle and lowest on the outer sides. Preferably, the segments 86 are mirrored regions formed on an otherwise blackened glass panel 87. Alternatively, the flame segments 86 could be formed as flame shaped cut-outs of an opaque medium overlaid on the mirror 85.

During operation, light is produced by the lights 79 of the array 80 as it continuously rotates with the shaft 62 which is rotated about its horizontally aligned axis by the motor 70. As is shown in FIG. 2, a certain portion of the lights 79 are positioned to radiate onto the mirror 85 at any particular instant, and such light is represented by rays 88. The lights 79 and the position of the lights 79 that shine on the mirror 85 change continuously due to the rotation of the shaft 62, thereby producing moving patterns of light.

A substantial portion of the light of the rays 88 reflects off the mirror 85 and shines on the rear side 37 of the screen 35, which is represented by rays 89 in FIG. 2. The light rays 89 substantially transmit through the screen 35 and are seen by a viewer looking at the screen front side 36 as an image 91 located on the screen 35. Because the lights 79 of the array 80 are constantly rotating so as to change position and as some of the lights 79 are continuously passing out of view of the mirror 85 and other lights 79 are continuously passing into view of the mirror 85 (that is, they shine on and reflect off the mirror 85 when in such a position), the pattern reflected by the mirror 85 and consequently, the pattern of the screen image 91 is continuously changing. As the image 91 includes generally flame shaped regions and as the light forming them is changing continuously, the flame shaped image 91 has a flickering appearance which mimics a flame associated with a real burning log. Because the image 91 is located behind and extends above the pile of logs 10, a viewer senses or appears to see the logs burning as if they were on fire. Preferably, the lights 79 are an orange or yellow flame color, although such an effect may be provided by tinting of the rear side 37 of the screen 35 or tinting of the flame segments 86 of the mirror 85.

Located behind the vent 41 is a fan 93 and an electrical heater element 94 (FIG. 3). Located beneath the pile of logs 10 in the fire hot box 31 are a pair of lights 95 which are on a control circuit that continuously varies intensity when operating. When illuminated, these lights 95 diffusely penetrate through the pile of logs 10 to simulate the glow of a fire and embers therein.

The control station 42 is connected electrically to an electrical circuit generally identified by the schematic electrical controller 96. The control station includes first, second, third and fourth toggle switches 97, 98, 99 and 100. The switch 97 turns on or off the simulator 1. The switch 98 turns on or off the flame simulating structure (motor 70, shaft 62 and lights 79) to produce the visual image 91. Switch 99 turns on or off the heater element 94. The switch 100 is a high/low flame level control switch which controls the light level of the LED's 79. Alternatively, other switches be provided on the control station 42, such as a control to vary the heat level of the heating element 94. The various electrical components are joined to the controller 96 which is in turn connected to a power supply suitable for plugging into a conventional electrical outlet by circuitry of a well known type.

It is noted that the pile of logs 10 are preferably constructed of plastic or the like to mimic real logs with ashes and the like and is partially transparent to allow light from the lights 95 to diffuse therethrough to give a glowing or ember like appearance.

Figure 7:
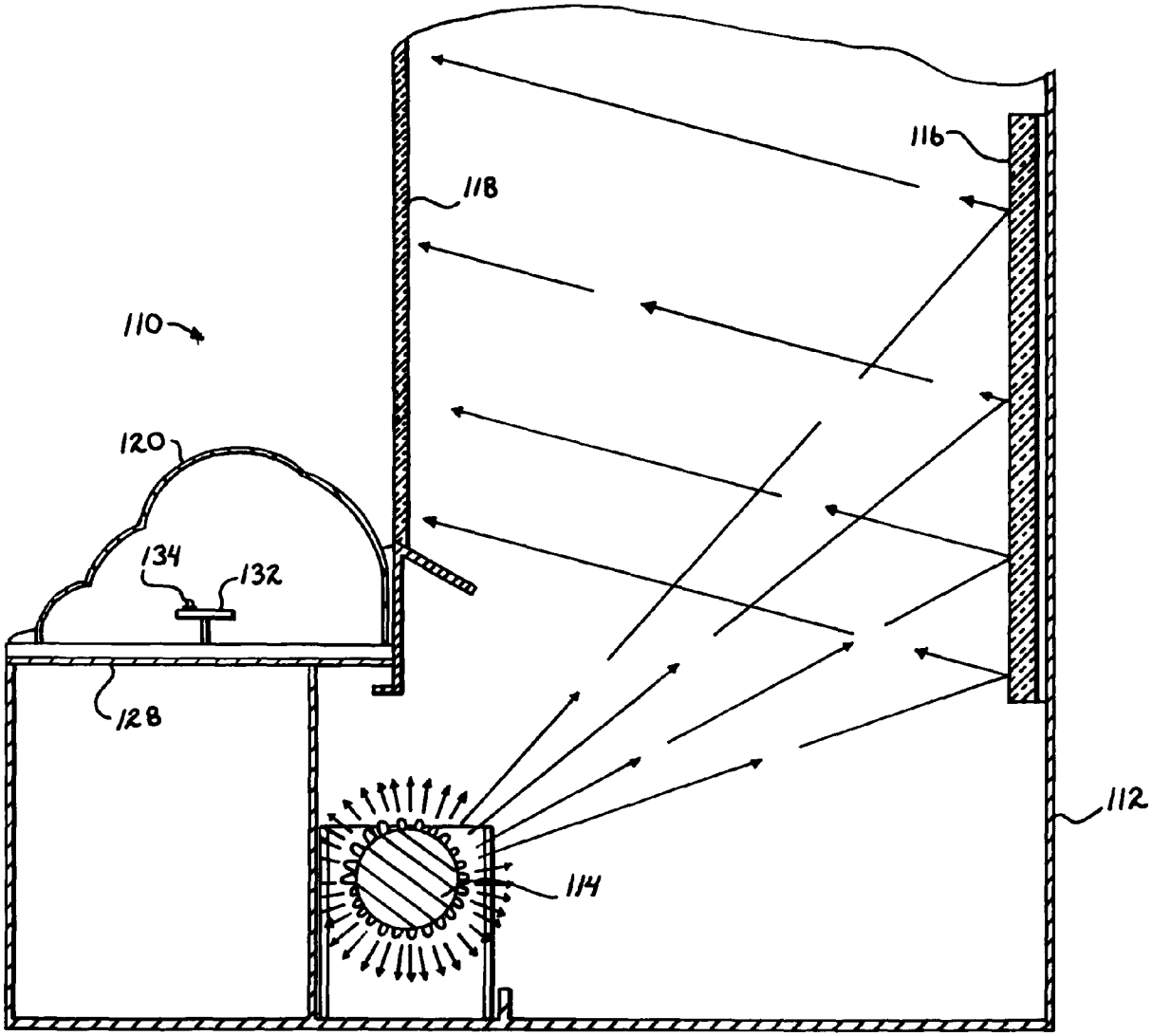
FIG. 7 is an enlarged fragmentary vertical front-to-back sectional view similar to FIG. 2 and illustrates an alternative embodiment of the simulator with an ember array of LED's to simulate glowing embers.
Figure 8:
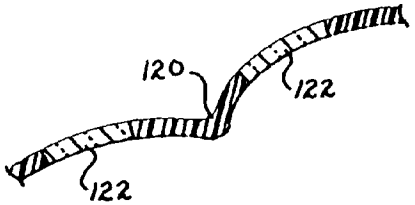
FIG. 8 is a greatly enlarged fragmentary sectional view of a wall of a simulated log and illustrates light transmissive regions therein.
Figure 9:
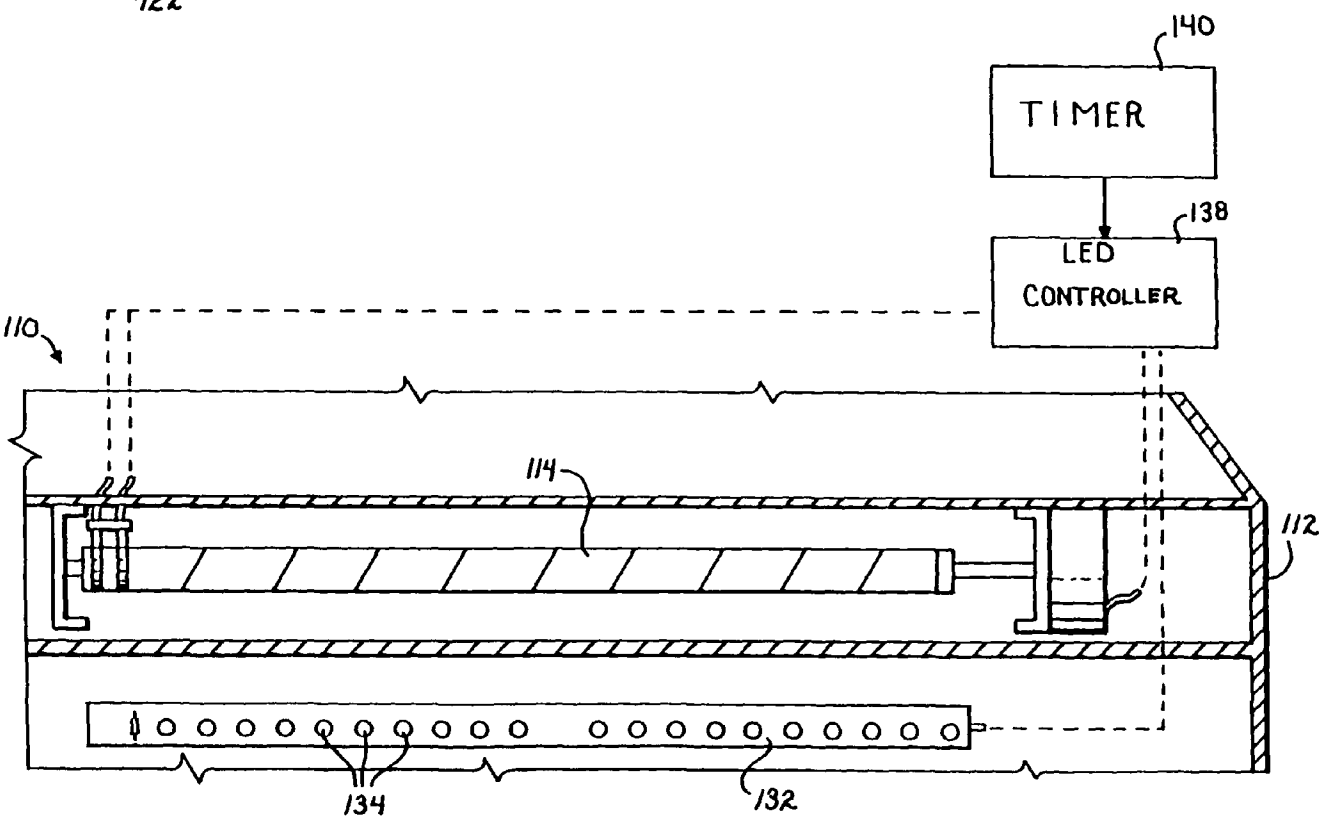
FIG. 9 is an enlarged fragmentary sectional view similar to FIG. 5 and illustrates the relative position of the ember array of LED's within the simulator housing.

FIGS. 7-9 illustrate a modified embodiment of a fireplace simulator apparatus 110 which includes components for creating an enhanced glowing ember effect. The apparatus 110 is similar in many respects to the fireplace simulator 1 and includes a housing 112 rotatably supporting a light array 114 which cooperates with a mirror 116 and a one-way mirror screen 118 to create moving patterns of light which resemble flickering flames.

The apparatus 110 includes a simulated log structure 120 which is shaped and colored to resemble logs within a fireplace. For example, the log structure 120 may be blackened to resemble charring and include white or gray flecks to resemble areas of ash. The log structure 120 may also include portions which resemble coals which have dropped from the logs or the still glowing remnants of a mostly consumed log. The illustrated log structure 120 is a molded sheet, as of a suitable plastic, and preferably includes light transmissive ember regions 122 (FIG. 8) to simulate glowing embers within the simulated logs. The ember regions 122 may be regions of flame colored transparent or translucent material embedded within the sheet forming the log structure 120. Alternatively, the log structure 120 con be formed as laminated layers (not shown), including a light transmissive layer overlaid by an opaque layer with cut-out areas to form the ember regions 122 in cooperation with the light transmissive layer.

The simulated log structure 120 shown in FIG. 7 is a hollow structure mounted on front shelf 128 of the housing 112. Light sources are provided to illuminate the log structure 120 from below and behind the structure 120 to radiate light through the ember regions 122. The light sources could be incandescent lamps similar to the lamps 95 of the simulator 1. However, the illustrated apparatus 110 is provided with an ember illuminating light array 132 including a plurality of light emitting diodes (LED's) 134. While a linear array 132 of LED's 134 is illustrated in FIG. 9, it is foreseen that two dimensional or three dimensional arrays of LED's could be alternatively provided.

The LED's 134 may be connected for activation in unison, in groups, or even individually. The apparatus 110 includes LED control circuitry 138 which controls activation of the LED's 134, as well as the rotary flickering flame array 114. The circuitry 138 may include a microprocessor or microcontroller which is programmed to respond to switches (not shown) similar to the switches 97-100 to control activation of the various components of the simulator 110. The apparatus 110 may include timer circuitry 140 which provides a timer signal to the control circuitry 138.

The LED control circuitry 138 preferably controls the ember LED's 134 to glow and fade ad seemingly randomly varying rates to simulate the effect of glowing embers subjected to randomly varying currents of air. The patterns of variation need not be actually random. It is will known in computer arts to generate pseudo-random patterns which proceed for relatively long periods before repetition. It is also known to "seed" pseudo-random pattern generators to change the patterns or the starting point of the pattern. For example, the seed could be a count generated between the time of overall activation of the control circuitry 138 and the time of activation of a switch controlling the ember LED's 134. Such a count can be derived from the timer signal from the timer circuitry 140. The patterns of activation of the ember LED's 134 can be combinations of relatively fast flickering illumination levels and relatively slower rising and falling illumination levels to simulate the appearance of real burning embers.

It is to be understood that while certain forms of the present invention have been illustrated and described herein, it is not to be limited to the specific forms or arrangement of parts described and shown.

The invention claimed is:

1. A fireplace simulator apparatus for providing a flickering visual image simulating burning logs and comprising:

(a) a housing;

(b) a shaft rotatably mounted within said housing in a horizontal orientation;

(c) a motor engaged with said shaft and activated to rotate same;

(d) a first light array of light sources positioned along said shaft and to rotating therewith upon activation of said motor to form moving patterns of light;

(e) a mirror mounted in said housing, having flame shaped regions, and positioned opposite said light array to reflect said moving patterns of light from at least a portion of said light array;

(f) a screen mounted in said housing in spaced relation to said mirror to receive a flickering flame shaped image reflected from said mirror onto a rear side of said screen; said screen being sufficiently transparent to transmit said image and to display the flickering flame shaped image on a front side of the screen;

(g) a simulated log positioned on said housing forward of said screen and having colored light transmissive ember regions;

(h) a second array of light emitting diodes positioned within said housing to radiate light through said ember regions of said simulated log; and (i) light control circuitry coupled to said second array of light emitting diodes and controlling said diodes to radiate said light at apparently randomly varying illumination levels in such a manner as to cause illumination of said ember regions to thereby simulate glowing embers on said simulated log.

2. An apparatus as set forth in claim 1 wherein:

(a) said second array includes a linear array of light emitting diodes.

3. An apparatus as set forth in claim 1 and including:

(a) an electrical heating element mounted in said housing and activated to radiate heat therefrom.

4. An apparatus as set forth in claim 1 wherein:

(a) said light control circuitry includes timer circuitry generating a time signal; and (b) said light control circuitry controls an illumination level of said second array according to an apparently random timing pattern derived from said time signal.

* * * * *